US011694638B1

(12) United States Patent
Choi et al.

(10) Patent No.: US 11,694,638 B1
(45) Date of Patent: Jul. 4, 2023

(54) DISPLAY DEVICE

(71) Applicant: LG Display Co., Ltd., Seoul (KR)

(72) Inventors: Yongkyun Choi, Goyang-si (KR); Junghoon Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/982,267

(22) Filed: Nov. 7, 2022

(30) Foreign Application Priority Data

Dec. 9, 2021 (KR) ..... 10-2021-0175466

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0842* (2013.01); *G09G 2310/0278* (2013.01); *G09G 2320/0271* (2013.01)

(58) Field of Classification Search
CPC ..... G09G 3/3291; G09G 3/3266
See application file for complete search history.

(56) References Cited

U.S. PATENT DOCUMENTS 10,490,132 B2 * 11/2019 Park ..... G09G 3/3266
11,455,952 B2 * 9/2022 Kim ..... G09G 3/3233
2019/0266952 A1 * 8/2019 Pyo ..... G09G 3/3291

FOREIGN PATENT DOCUMENTS

KR 10-2008-0060897 A 7/2008

* cited by examiner

*Primary Examiner* — Sardis F Azongha
(74) *Attorney, Agent, or Firm* — Morgan, Lewis & Bockius LLP

(57) ABSTRACT

According to an aspect of the present disclosure, a display device includes a display panel in which a plurality of sub-pixels is disposed. Also, the display device includes a data driver configured to supply a plurality of data voltages to the plurality of sub-pixels through a plurality of data lines. Further, the display device includes a gate driver configured to supply a plurality of gate signals to the plurality of sub-pixels through a plurality of gate lines. Each of the plurality of sub-pixels includes a light emitting diode, a driving transistor, and a variable resistance circuit disposed in series between a low-potential voltage terminal and a high-potential voltage terminal. When each of the plurality of sub-pixels implements a low grayscale, the variable resistance circuit increases a resistance between the high-potential voltage terminal and the driving transistor. Thus, a low grayscale can be normally implemented.

13 Claims, 9 Drawing Sheets

DISPLAY DEVICE

CROSS-REFERENCE TO RELATED APPLICATIONS

This application claims the priority of Korean Patent Application No. 10-2021-0175466 filed on Dec. 09, 2021, in the Korean Intellectual Property Office, the disclosure of which is incorporated herein by reference.

BACKGROUND

Technical Field

The present disclosure relates to a display device, and more particularly, to a display device capable of controlling a voltage applied to a driving transistor.

Discussion of the Related Art

Display devices used for a computer monitor, a TV, a mobile phone, etc. include an organic light emitting display (OLED) that emits light by itself, a liquid crystal display (LCD) that requires a separate light source, etc.

The OLED includes a display panel including a plurality of sub-pixels and a driver unit for driving the display panel. The driver unit includes a gate driver for supplying gate signals to the display panel through gate lines and a data driver for supplying data voltages to the display panel through data lines. When signals such as gate signals and data voltages are supplied to the sub-pixels of the OLED, the selected sub-pixels emit light and thus display images.

Here, each of the plurality of sub-pixels includes a light emitting diode and a driving transistor disposed between a low-potential voltage and a high-potential voltage. When a low grayscale is implemented, a relatively low voltage is applied to the light emitting diode, and when a high grayscale is implemented, a relatively high voltage is applied to the light emitting diode.

Accordingly, when a low grayscale is implemented, a relatively high voltage is applied to the driving transistor, and when a high grayscale is implemented, a relatively low voltage is applied to the driving transistor.

That is, when a low grayscale is implemented, a voltage between a source electrode and a drain electrode of the driving transistor increases, which causes a kink effect in which a current between the source electrode and the drain electrode of the driving transistor rapidly increases. Accordingly, the sub-pixels cannot implement a low grayscale and thus implement a relatively high grayscale.

SUMMARY

Accordingly, embodiments of the present disclosure are directed to a display device that substantially obviates one or more of the problems due to limitations and disadvantages of the related art.

An aspect of the present disclosure is to provide a display device capable of suppressing a kink effect.

Another aspect of the present disclosure is to provide a display device capable of stably implementing a low grayscale.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device comprises a display panel in which a plurality of sub-pixels is disposed. Also, the display device includes a data driver configured to supply a plurality of data voltages to the plurality of sub-pixels through a plurality of data lines. Further, the display device includes a gate driver configured to supply a plurality of gate signals to the plurality of sub-pixels through a plurality of gate lines. Each of the plurality of sub-pixels includes a light emitting diode, a driving transistor, and a variable resistance circuit disposed in series between a low-potential voltage terminal and a high-potential voltage terminal. When each of the plurality of sub-pixels implements a low grayscale, the variable resistance circuit increases a resistance between the high-potential voltage terminal and the driving transistor. Thus, a low grayscale can be normally implemented.

Other matters of the exemplary embodiments are included in the detailed description and the drawings.

According to the present disclosure, when a sub-pixel implements a low grayscale, a voltage of a drain electrode of a driving transistor is shifted. Thus, it is possible to suppress a kink effect in the driving transistor.

According to the present disclosure, a low driving current can flow in a light emitting diode. Thus, the sub-pixel can normally implement a low grayscale.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
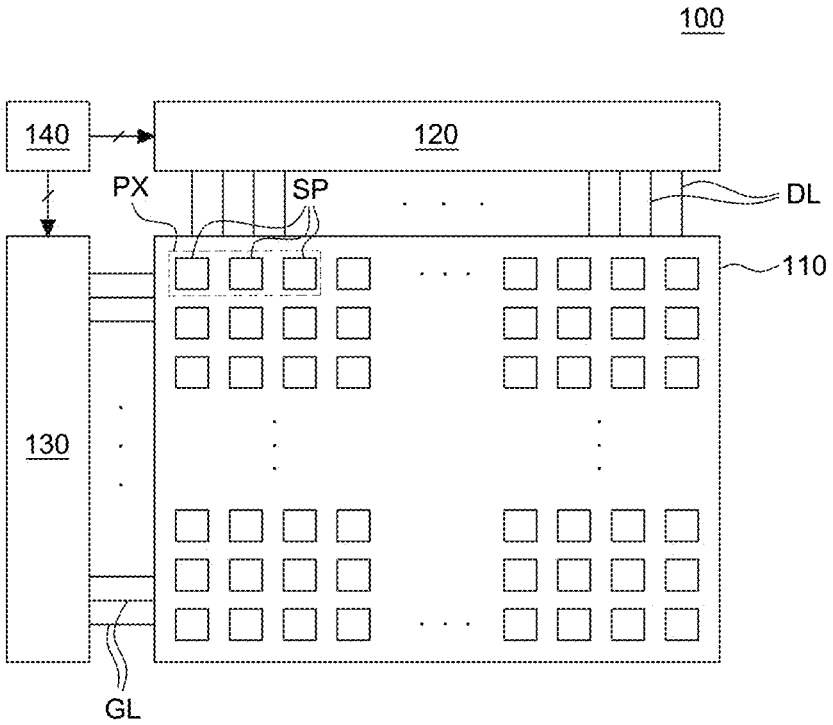
FIG. 1 is a schematic diagram illustrating a display device according to an exemplary embodiment of the present disclosure.

Advantages and characteristics of the present disclosure and a method of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

A transistor used in a display device of the present disclosure may be implemented as at least one transistor of an n-channel transistor (NMOS) and a p-channel transistor (PMOS). The transistor may be implemented as an oxide semiconductor transistor having an oxide semiconductor as an active layer or a low temperature poly-silicon (LTPS) transistor having LTPS as an active layer. The transistor may include at least a gate electrode, a source electrode, and a drain electrode. The transistor may be implemented as a thin film transistor (TFT) on a display panel. In the transistor, carriers flow from the source electrode to the drain electrode. In the NMOS, carriers are electrons, and, thus, a source voltage is lower than a drain voltage so that the electrons can flow from the source electrode to the drain electrode. In the NMOS, a current may flow from the drain electrode to the source electrode and the source electrode may be an output terminal. In the PMOS, carriers are holes, and, thus, the source voltage is higher than the drain voltage so that the holes can flow from the source electrode to the drain electrode. In the PMOS, the holes flow from the source electrode to the drain electrode, and, thus, a current flows from a source to a drain and the drain electrode may be an output terminal. Therefore, it should be noted that the source and drain of the transistor are not fixed since the source and drain can be changed depending on an applied voltage. In the present disclosure, it is assumed that the transistor is the NMOS, but is not limited thereto and the PMOS may be used. Accordingly, a circuit configuration may be changed.

Gate signals for transistors used as switching elements swing between a turn-on voltage and a turn-off voltage. The turn-on voltage is set to a voltage higher than a threshold voltage of the transistors, and the turn-off voltage is set to a voltage lower than the threshold voltage of the transistors. The transistors turn on in response to the turn-on voltage and turn off in response to the turn-off voltage. In the NMOS, the turn-on voltage may be a high voltage, and the turn-off voltage may be a low voltage. In the PMOS, the turn-on voltage may be a low voltage, and the turn-off voltage may be a high voltage.

Hereinafter, various exemplary embodiments of the present disclosure will be described in detail with reference to the accompanying drawings.

FIG. 1 is a schematic diagram illustrating a display device according to an exemplary embodiment of the present disclosure. Referring to FIG. 1, a display device 100 includes a display panel 110, a gate driver 120, a data driver 130, and a timing controller 140.

The display panel 110 is a panel for displaying an image. The display panel 110 may include various circuits, lines, and light emitting diodes disposed on a substrate. The display panel 110 may include a plurality of pixels PX defined by a plurality of data lines DL and a plurality of gate lines GL which intersect each other. Also, the plurality of pixels PX is connected to the plurality of data lines DL and the plurality of gate lines GL. The display panel 110 may include a display area defined by the plurality of pixels PX and a non-display area in which various signal lines or pads are formed. The display panel 110 may be implemented by a display panel 110 used in various display devices such as a liquid crystal display device, an organic light emitting display device, or an electrophoretic display device. In the following description, the display panel 110 is described as a panel used in an organic light emitting display device, but is not limited thereto.

The timing controller 140 receives timing signals such as a vertical synchronization signal, a horizontal synchronization signal, a data enable signal, and a dot clock via a receiving circuit such as LVDS (Low Voltage Differential Signaling) or TMDS (Transition Minimized Differential Signaling) interface connected to a host system. The timing controller 140 generates timing control signals for controlling the data driver 130 and the gate driver 120 based on the received timing signals.

The data driver 130 supplies a data voltage to a plurality of sub-pixels SP. The data driver 130 may include a plurality of source drive integrated circuits (ICs). The plurality of source drive ICs may receive digital video data and a source timing control signal from the timing controller 140. The plurality of source drive ICs may convert the digital video data into a gamma voltage in response to a source timing control signal to generate a data voltage. Also, the plurality of source drive ICs may supply the data voltage via the data lines DL of the display panel 110. The plurality of source drive ICs may be connected to the data lines DL of the display panel 110 by a chip-on-glass (COG) process or a tape automated bonding (TAB) process. In addition, the source drive ICs may be formed on the display panel 110, or may be formed on a separate PCB and connected to the display panel 110.

The gate driver 120 supplies gate signals to the plurality of sub-pixels SP. The gate driver 120 may include a level shifter and a shift register. The level shifter may shift the level of a clock signal input at the transistor-transistor-logic (TTL) level from the timing controller 140 and then may supply it to the shift register. The shift register may be formed in the non-display area of the display panel 110 by using a GIP technique, but is not limited thereto. The shift register may include a plurality of stages for shifting gate signals to output them in response to the clock signal and a driving signal. The plurality of stages included in the shift register may sequentially output gate signals through the plurality of output terminals. As will be described later, the gate signals may include a scan signal, a sensing signal, and an initialization signal.

The display panel 110 may include a plurality of sub-pixels SP. The plurality of sub-pixels SP may emit light of different colors. For example, the plurality of sub-pixels SP may include a red sub-pixel, a green sub-pixel, and a blue sub-pixel, but is not limited thereto. The plurality of sub-pixels SP may form a pixel PX. That is, a red sub-pixel, a green sub-pixel, and a blue sub-pixel may form a single pixel PX, and the display panel 110 may include a plurality of pixels PX.

Hereinafter, a driver circuit for driving a single sub-pixel SP will be described in detail with reference to FIG. 2 and FIG. 3.

Figure 2:
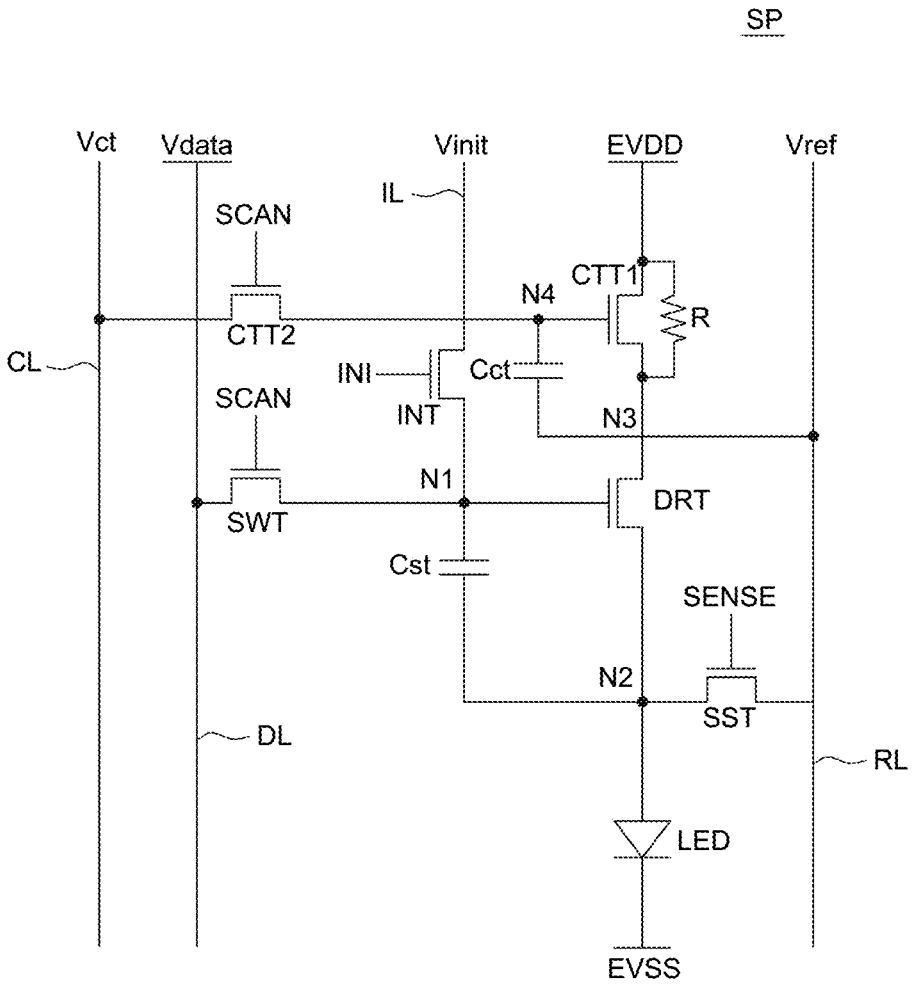
FIG. 2 and FIG. 3 are circuit diagrams illustrating a sub-pixel of the display device according to an exemplary embodiment of the present disclosure.
Figure 3:
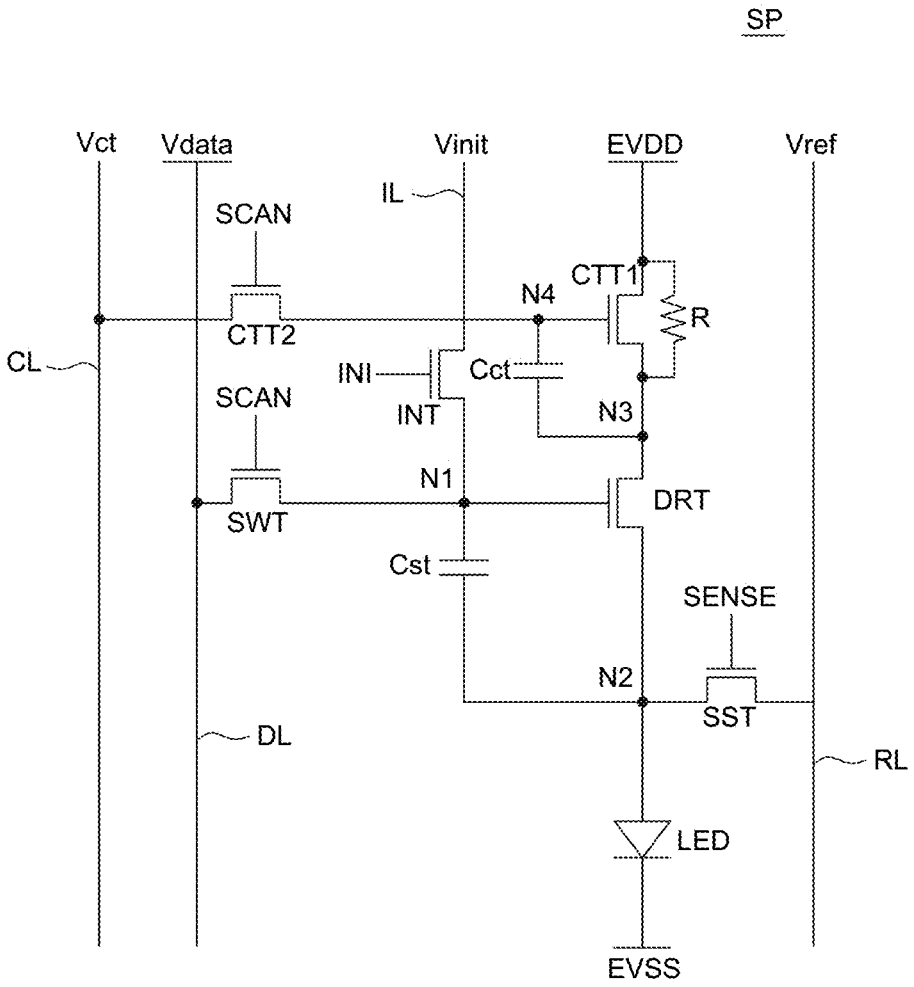

FIG. 2 and FIG. 3 are circuit diagrams illustrating a sub-pixel of the display device according to an exemplary embodiment of the present disclosure.

FIG. 2 and FIG. 3 are circuit diagrams illustrating one sub-pixel SP of the plurality of sub-pixels SP of the display device 100. Specifically, FIG. 2 illustrates a case where a control capacitor Cct is connected to a reference voltage line, and FIG. 3 illustrates a case where the control capacitor Cct is connected to a driving transistor.

Referring to FIG. 2, each sub-pixel SP includes a light emitting diode LED, a driving transistor DRT, a switching transistor SWT, a sensing transistor SST, an initialization transistor INT, a storage capacitor Cst, and a variable resistance circuit CTT1, CTT2, R, and Cct.

The light emitting diode LED emits light by a driving current supplied from the driving transistor DRT. An anode electrode of the light emitting diode LED is connected to the storage capacitor Cst, the driving transistor DRT, and the sensing transistor SST. Also, a cathode electrode of the light emitting diode LED is connected to a low-potential voltage terminal to which a low-potential voltage EVSS is applied.

The driving transistor DRT controls the driving current applied to the light emitting diode LED based on its source-gate voltage Vsg. Further, a gate electrode of the driving transistor DRT is connected to a first node N1, its source electrode is connected to a second node N2, and its drain electrode is connected to a third node N3.

The switching transistor SWT applies a data voltage Vdata supplied from the data line DL to the first node N1, which is the gate electrode of the driving transistor DRT. The switching transistor SWT includes a drain electrode connected to the data line DL, a source electrode connected to the first node N1, and a gate electrode connected to a gate line for transmitting a scan signal SCAN. Accordingly, the switching transistor SWT applies the data voltage Vdata supplied from the data line DL to the first node N1, which is the gate electrode of the driving transistor DRT, in response to the scan signal SCAN of a high level, which is a turn-on level.

The sensing transistor SST applies a reference voltage Vref to the anode electrode of the light emitting diode LED. The sensing transistor SST includes a drain electrode connected to a reference voltage line RL for transmitting the reference voltage Vref. The sensing transistor SST also includes a source electrode connected to the anode electrode of the light emitting diode LED and a gate electrode connected to a gate line for transmitting a sensing signal SENSE. Accordingly, the sensing transistor SST applies the reference voltage Vref to the anode electrode of the light emitting diode LED in response to the sensing signal SENSE of a high level, which is a turn-on level. Thus, the sensing transistor SST senses a voltage of the anode electrode of the light emitting diode LED.

The initialization transistor INT applies an initialization voltage Vinit to the first node N1, which is the gate electrode of the driving transistor DRT. The initialization transistor INT includes a drain electrode connected to an initialization voltage line IL for transmitting the initialization voltage Vinit. The initialization transistor INT also includes a drain electrode connected to the first node N1, which is the gate electrode of the driving transistor DRT, and a gate electrode connected to an initialization signal line IL for transmitting an initialization signal INI. Accordingly, the initialization transistor INT applies the initialization voltage Vinit to the first node N1, which is the gate electrode of the driving transistor DRT, in response to the initialization signal INI of a high level, which is a turn-on level. Thus, the initialization transistor INT initializes the driving transistor DRT.

The storage capacitor Cst includes a first electrode connected to the second node N2 and a second electrode connected to the second node N2. That is, one electrode of the storage capacitor Cst is connected to the gate electrode of the driving transistor DRT, and the other electrode of the storage capacitor Cst is connected to the gate electrode of the driving transistor DRT.

When each of the plurality of sub-pixels implements a low grayscale, the variable resistance circuit CTT1, CTT2, R, and Cct increases a resistance between a high-potential voltage terminal and the driving transistor DRT.

The variable resistance circuit CTT1, CTT2, R, and Cct includes a first control transistor CTT1, a second control transistor CTT2, a resistor R, and the control capacitor Cct.

The first control transistor CTT1 includes a drain electrode connected to the high-potential voltage terminal to which a high-potential voltage EVSS is applied, a source electrode connected to the third node N3 connected to the driving transistor DRT. The first control transistor CTT1 also includes a gate electrode connected to a fourth node N4 connected to the second control transistor CTT2.

One electrode of the resistor R is connected to the third node N3 and the other electrode is connected to the fourth node N4. The resistor R is disposed between the source electrode and the drain electrode of the first control transistor CTT1.

In other words, the first control transistor CTT1 and the resistor R may be connected in parallel between the high-potential voltage terminal and the driving transistor DRT.

Further, the source electrode of the second control transistor CTT2 is connected to the fourth node N4 and the gate electrode of the second control transistor CTT2 is connected to the gate line for transmitting a scan signal SCAN. Furthermore, the drain electrode of the second control transistor CTT2 is connected to a control line CL for transmitting a control voltage Vct.

Accordingly, the second control transistor CTT2 may control the first control transistor CTT1.

Specifically, the second control transistor CTT2 applies the control voltage Vct supplied from the control line CL to the fourth node N4, which is the gate electrode of the first control transistor CTT1, in response to the scan signal SCAN of a high level, which is a turn-on level.

Then, the first control transistor CTT1 operates depending on the level of the control voltage Vct transferred through the second control transistor CTT2. Specifically, when the control voltage Vct has a high level, which is a turn-on level, the first control transistor CTT1 is turned on. Also, a current path in parallel with the resistor R is formed between the high-potential voltage terminal and the driving transistor DRT. Accordingly, a resistance value between the high-potential voltage terminal and the driving transistor DRT may decrease. In contrast, when the control voltage Vct has a low level, which is a turn-off level, the first control transistor CTT1 is turned off. Also, the current path in parallel with the resistor R is not formed between the high-potential voltage terminal and the driving transistor DRT. Accordingly, the resistance value between the high-potential voltage terminal and the driving transistor DRT may increase.

Meanwhile, referring to FIG. 2, the control capacitor Cct includes a first electrode connected to the fourth node N4 and a second electrode connected to the reference voltage line RL. That is, one electrode of the storage control capacitor Cct is connected to the gate electrode of the first control transistor CTT1 and the other electrode of the control capacitor Cct is connected to the reference voltage line RL for transferring the reference voltage Vref which is a constant voltage.

Referring to FIG. 3, the control capacitor Cct includes a first electrode connected to the fourth node N4 and a second electrode connected to the third node N3. That is, one electrode of the storage control capacitor Cct is connected to the gate electrode of the first control transistor CTT1 and the other electrode of the control capacitor Cct is connected to the source electrode of the first control transistor CTT1.

Accordingly, the control capacitor Cct may maintain the control voltage Vct stored in the fourth node N4 for a predetermined period of time. That is, the control capacitor Cct may maintain the control voltage Vct applied to the gate electrode of the first control transistor CTT1 for a predetermined period of time to maintain an operation of the first control transistor CTT1.

FIG. 4A through FIG. 4D are waveform charts showing gate signals of the display device according to an exemplary embodiment of the present disclosure.

Figure 4A:
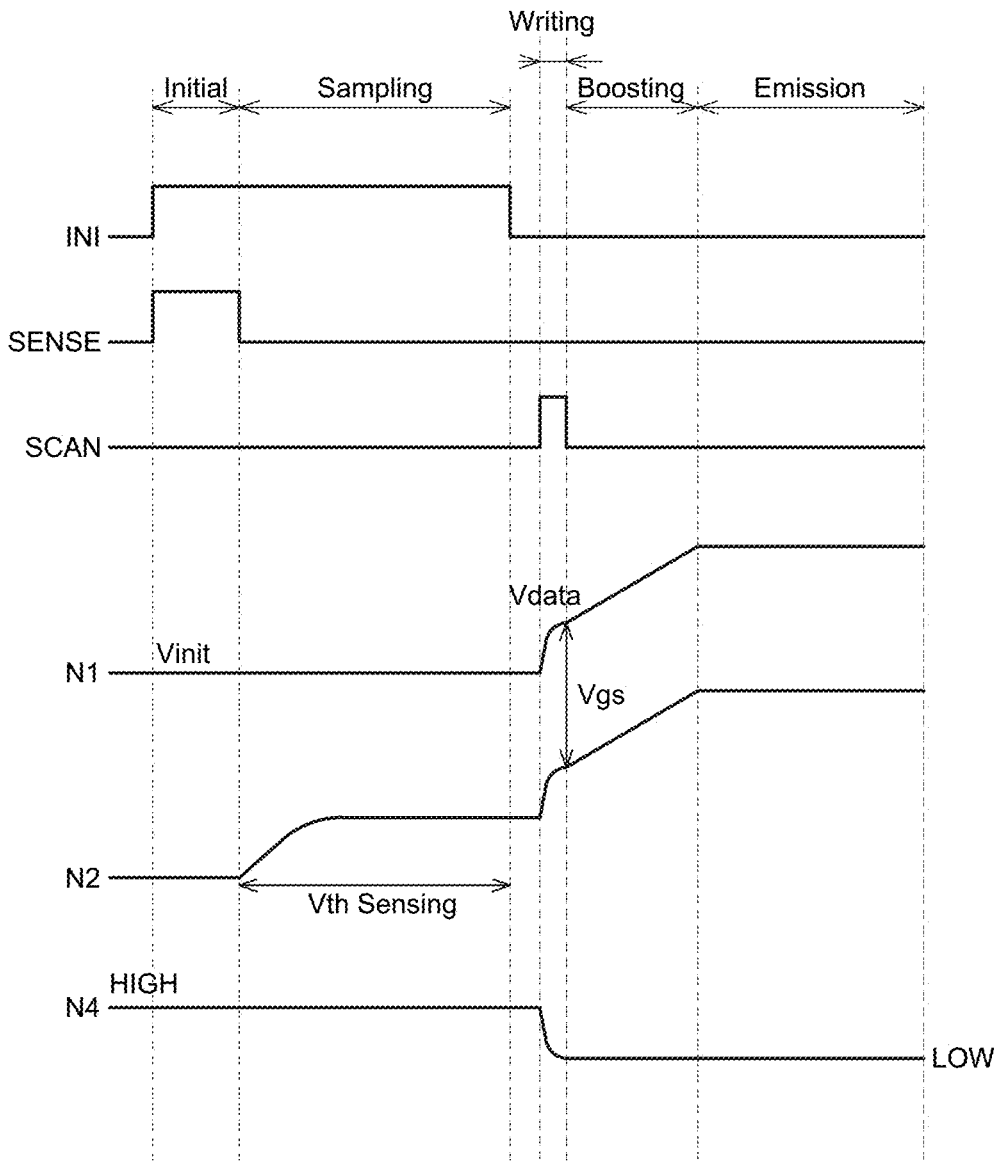
FIG. 4A through FIG. 4D are waveform charts showing gate signals of the display device according to an exemplary embodiment of the present disclosure.
Figure 4B:
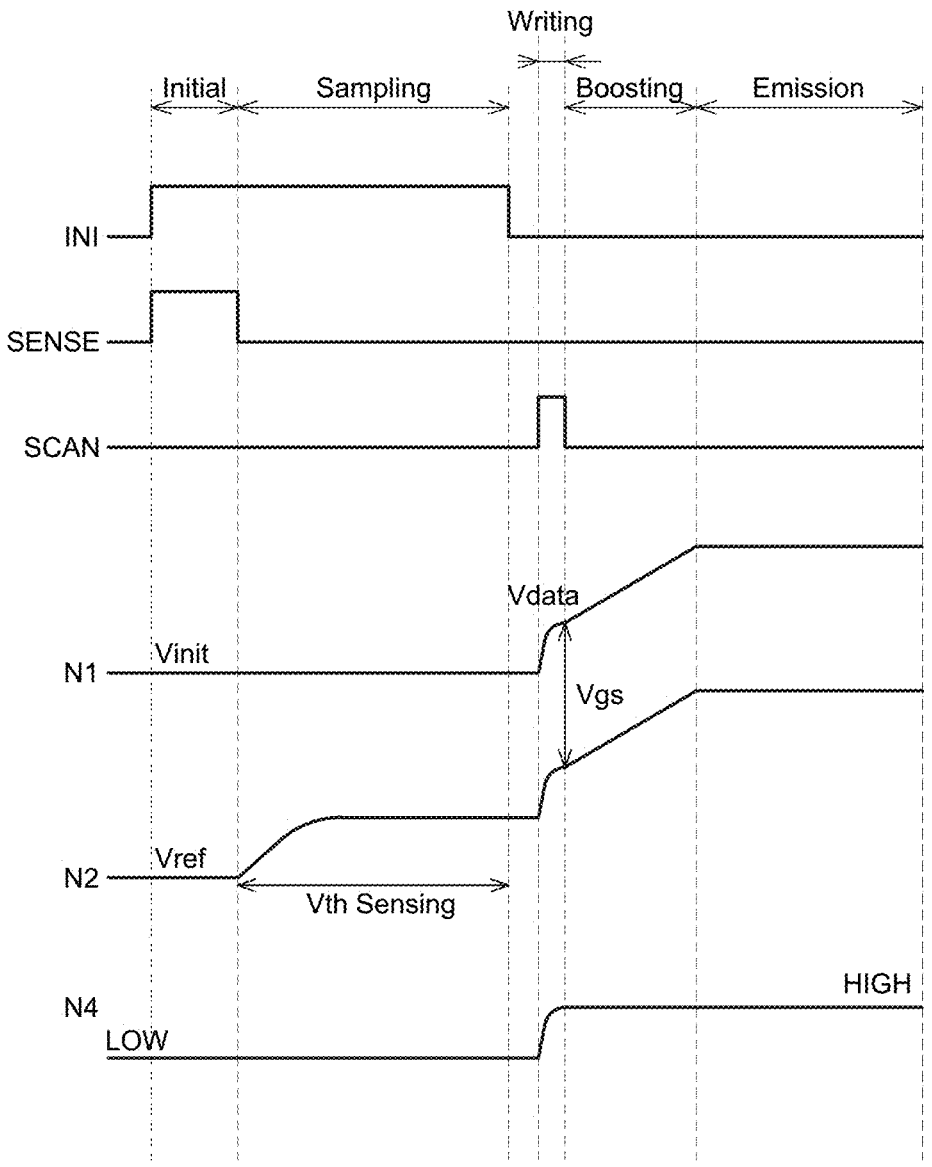
Figure 4C:
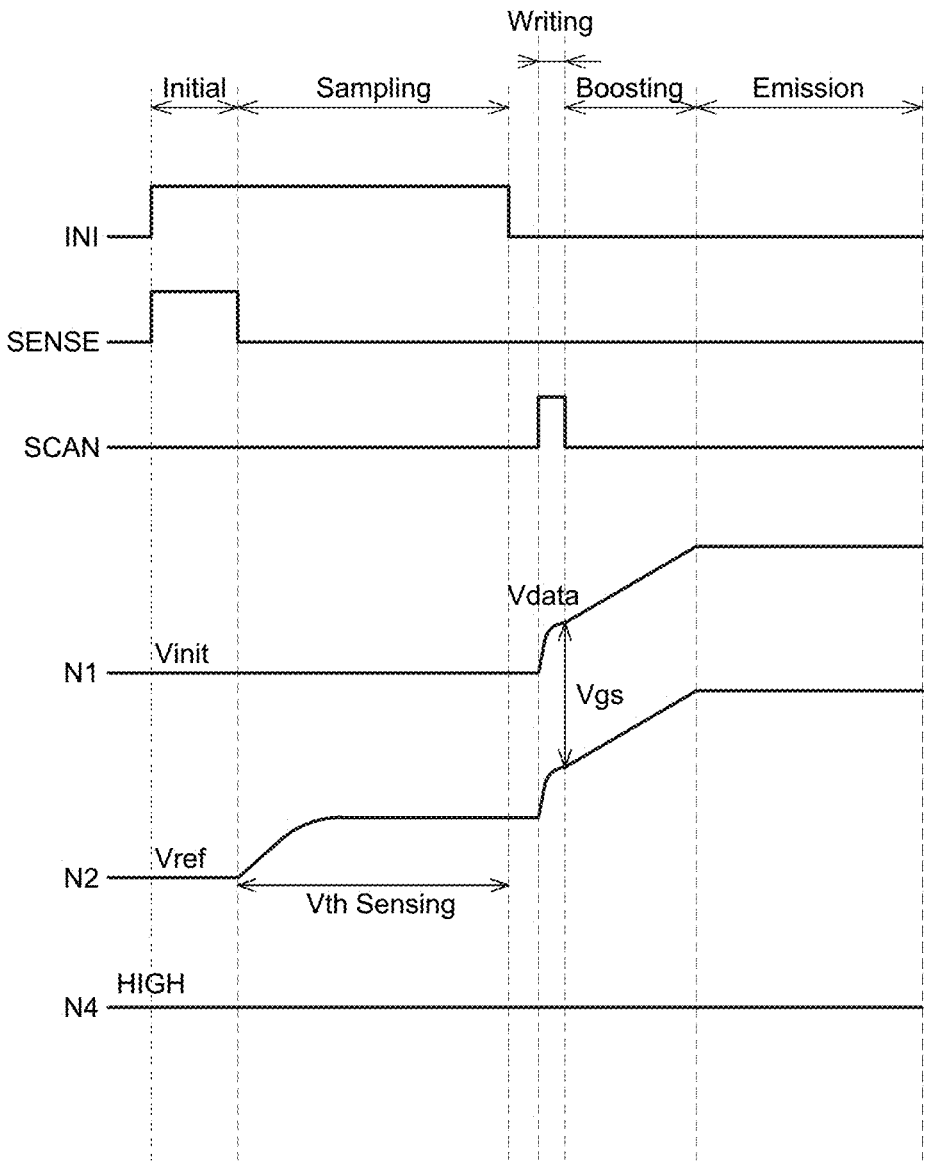
Figure 4D:
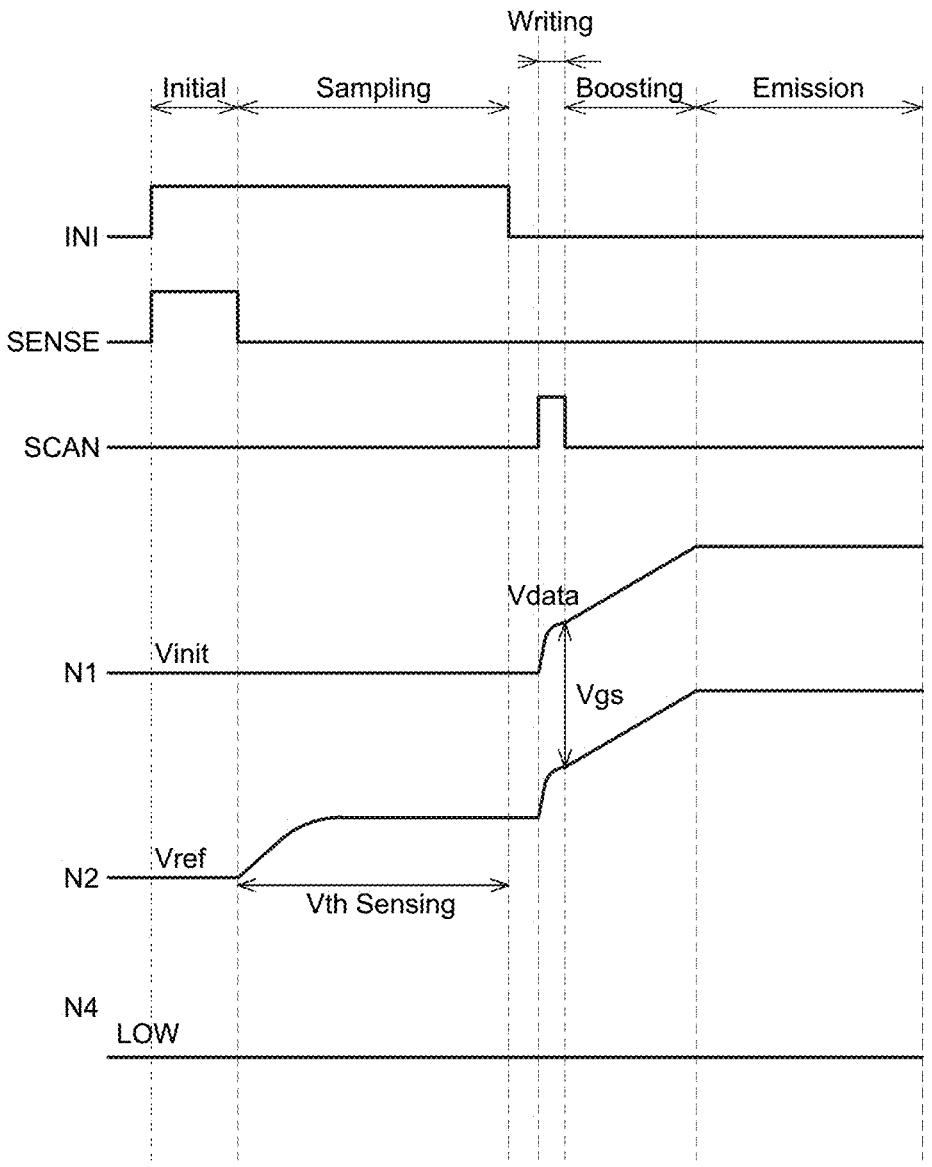

In FIG. 4A through FIG. 4D, the signals and voltages except for the control voltage Vct applied to the fourth node N4 have the same level. FIG. 4A illustrates a waveform in a case where the grayscale of a sub-pixel is changed from a high grayscale to a low grayscale. FIG. 4B illustrates a waveform in a case where the grayscale of a sub-pixel is changed from a low grayscale to a high grayscale. FIG. 4C illustrates a waveform in a case where the grayscale of a sub-pixel is maintained high, and FIG. 4D illustrates a waveform in a case where the grayscale of a sub-pixel is maintained low.

Driving of the display device according to an exemplary embodiment of the present disclosure will be described with reference to FIG. 2 through FIG. 4D.

Referring to FIG. 4A through FIG. 4D, the initialization signal INI has a high level, which is a turn-on level, and the sensing signal SENSE has a high level, which is a turn-on level, during an initial period. Also, the scan signal SCAN has a low level, which is a turn-off level, during the initial period. Thus, the initialization transistor INT is turned on and applies the initialization voltage Vinit to the first node N1. As a result, the gate electrode of the driving transistor DRT is initialized to the initialization voltage Vinit. The initialization voltage Vinit may be selected within a range sufficiently lower than an operating voltage of the light emitting diode LED and set to be equal to or lower than a low-potential voltage VSS. Also, in the initial period, the sensing transistor SST is turned on and applies the reference voltage Vref to the second node N2. As a result, the sensing transistor SST applies the reference voltage Vref to the anode electrode of the light emitting diode LED and senses a voltage of the anode electrode of the light emitting diode LED. The reference voltage Vref may be selected within a range sufficiently lower than the operating voltage of the light emitting diode LED and set to be equal to or lower than the low-potential voltage VSS.

Further, referring to FIG. 4A through FIG. 4D, the initialization signal INI has a high level, which is a turn-on level, and the sensing signal SENSE has a low level, which is a turn-off level during a sampling period. Also, the scan signal SCAN has a low level, which is a turn-off level during the sampling period. Further, during the sampling period, the initialization transistor INT is continuously turned on and maintains the initialization voltage Vinit at the first node N1. However, during the sampling period, the sensing transistor SST is turned off, and, thus, a voltage of the second node N2 increases from the reference voltage Vref to a voltage equal to a difference between the initialization voltage Vinit and a threshold voltage Vth. In other words, the voltage of the second node N2 is increased by a current flowing from the source electrode to the drain electrode of the driving transistor DRT until a gate-source voltage Vgs of the driving transistor DRT reaches the threshold voltage Vth. Accordingly, the threshold voltage Vth of the driving transistor is sampled in the storage capacitor Cst.

Furthermore, referring to FIG. 4A through FIG. 4D, the initialization signal INI has a low level, which is a turn-off level, and the sensing signal SENSE has a low level, which is a turn-off level, during a writing period. Also, the scan signal SCAN has a high level, which is a turn-on level, during the writing period. Further, during the writing period, the switching transistor SWT is turned on and applies the data voltage Vdata to the first node N1. The threshold voltage Vth of the driving transistor is stored in the storage capacitor Cst. Thus, the voltage of the second node N2 increases so that a voltage difference between the second node N2 and the first node N1 is maintained at the threshold voltage Vth, which is the gate-source voltage Vgs of the driving transistor DRT.

Moreover, referring to FIG. 4A through FIG. 4D, the data voltage Vdata is applied to the first node N1, which is the gate electrode of the driving transistor DRT, during a boosting period. Therefore, the voltage of the second node N2 is boosted by a current flowing from the source electrode to the drain electrode. Further, the gate-source voltage Vgs of the driving transistor DRT is stored in the storage capacitor Cst. Thus, the voltage of the first node N1 increases so that a voltage difference between the first node N1 and the second node N2 is maintained at the threshold voltage Vth, which is the gate-source voltage Vgs of the driving transistor DRT.

During an emission period, a current path is formed between the driving transistor DRT and the light emitting diode LED by the boosted voltage of the second node N2. As a result, a driving current flowing through the source electrode and the drain electrode of the driving transistor DRT is applied to the light emitting diode LED.

Meanwhile, during the writing period in which a data voltage is written to a driving transistor, the voltage of the fourth node N4 may be changed.

As described above, the scan signal SCAN has a turn-on level during the writing period, and, thus, the second control transistor CTT2 is turned on. Accordingly, a change in the control voltage Vct during the writing period is reflected to the fourth node N4.

For example, as shown in FIG. 4A, when the grayscale of a sub-pixel is changed from a high grayscale to a low grayscale, the data voltage Vdata transitions to the data voltage Vdata equal to or lower than a threshold voltage so that a low grayscale is implemented. Therefore, the control voltage Vct transitions to the control voltage Vct of a low level. Accordingly, the voltage of the fourth node N4 decreases to the control voltage Vct of a low level during the writing period.

However, as shown in FIG. 4B, when the grayscale of a sub-pixel is changed from a low grayscale to a high grayscale, the data voltage Vdata transitions to the data voltage Vdata equal to or higher than the threshold voltage so that a high grayscale is implemented. Therefore, the control voltage Vct transitions to the control voltage Vct of a high level. Accordingly, the voltage of the fourth node N4 increases to the control voltage Vct of a high level during the writing period.

As shown in FIG. 4C, when the grayscale of a sub-pixel is maintained high, the data voltage Vdata is maintained at the data voltage Vdata equal to or higher than the threshold voltage so that a high grayscale is implemented. Therefore, the control voltage Vct is maintained at the control voltage Vct of a high level. Accordingly, the voltage of the fourth node N4 is maintained at the control voltage Vct of a high level during the writing period.

However, as shown in FIG. 4D, when the grayscale of a sub-pixel is maintained low, the data voltage Vdata is maintained at the data voltage Vdata equal to or lower than the threshold voltage so that a low grayscale is implemented. Therefore, the control voltage Vct is maintained at the control voltage Vct of a low level. Accordingly, the voltage of the fourth node N4 is maintained at the control voltage Vct of a low level during the writing period.

The threshold voltage may refer to a predetermined voltage level between a data voltage at a low grayscale and a data voltage at a high grayscale.

In order to implement the above-described operation, the control voltage Vct may be output as a low level, which is a turn-off level, when the data voltage Vdata is lower than the threshold voltage before the writing period. Also, the control voltage Vct may be output as a high level, which is a turn-on level, when the data voltage Vdata is higher than the threshold voltage before the writing period.

Hereinafter, according to an exemplary embodiment of the present disclosure, driving of the display device to implement a low grayscale and driving of the display device to implement a high grayscale will be described with reference to FIG. 5 and FIG. 6.

Figure 5:
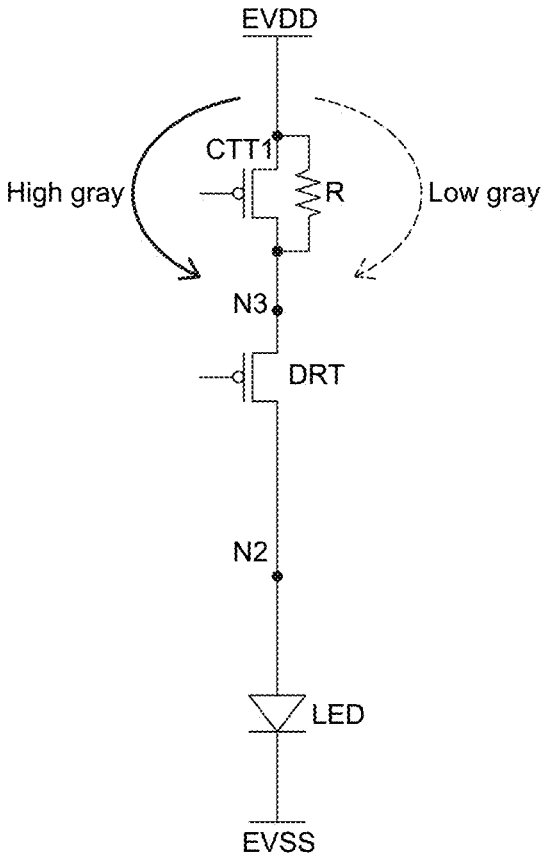
FIG. 5 is a circuit diagram for explaining an operation of a variable resistance circuit of the display device according to an exemplary embodiment of the present disclosure.

FIG. 5 is a circuit diagram for explaining an operation of a variable resistance circuit of the display device according to an exemplary embodiment of the present disclosure.

Figure 6:
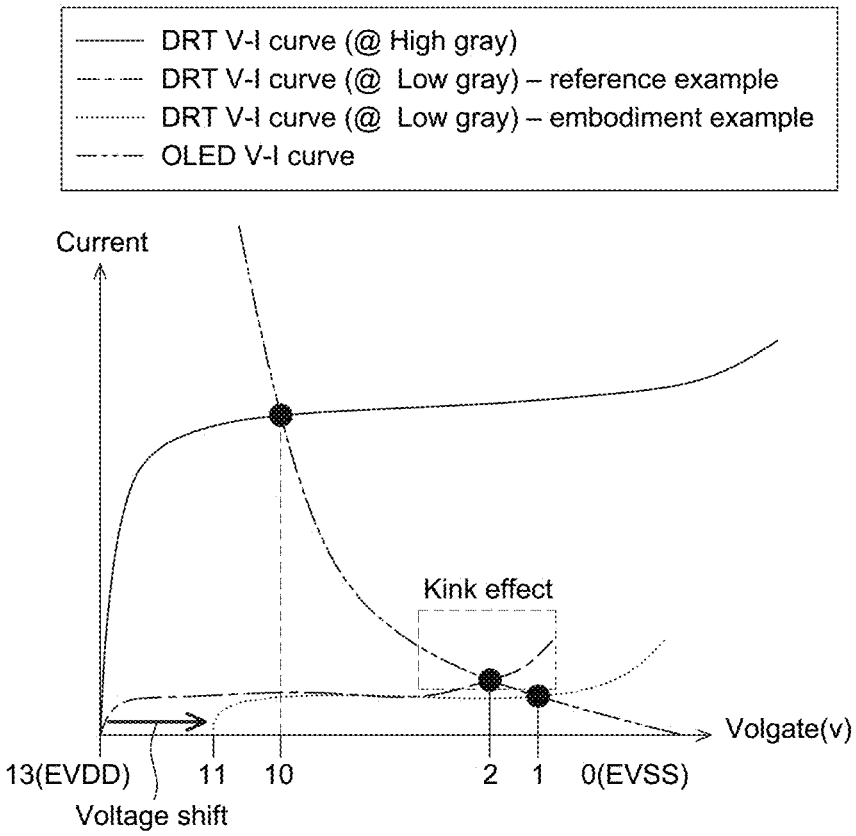
FIG. 6 is a circuit diagram for explaining a relationship between a driving current and a voltage of the display device according to an exemplary embodiment of the present disclosure.

FIG. 6 is a circuit diagram for explaining a relationship between a driving current and a voltage of the display device according to an exemplary embodiment of the present disclosure.

FIG. 6 illustrates a voltage relationship, for example, when a high-potential voltage EVDD to be applied to the high-potential voltage terminal is set to 13 V and the low-potential voltage EVSS to be applied to the low-potential voltage terminal is set to 0 V.

As shown in FIG. 5, when a sub-pixel implements a high grayscale, the control voltage Vct has a high level. Thus, the first control transistor CTT1 is turned on. Accordingly, a current flows between the high-potential voltage terminal and the third node N3 through the first control transistor CTT1. Therefore, a voltage drop between the high-potential voltage terminal and the third node N3 is insignificant. That is, a resistance value between the high-potential voltage terminal and the driving transistor DRT is close to 0. Accordingly, when a line resistance is ignored, a voltage of the third node N3 may be the high-potential voltage EVDD.

Accordingly, as shown in FIG. 6, a voltage between the source electrode and the drain electrode (the second node N2 and the third node N3) of the driving transistor DRT is 3 V in a VI curve of the driving transistor DRT when a sub-pixel implements a high grayscale. Therefore, the voltage of the second node N2 is 10 V. Also, a voltage between the anode electrode and the cathode electrode of the light emitting diode LED is 10 V in a VI curve of the light emitting diode LED. Therefore, a high driving current flows in the light emitting diode LED, which makes it possible to implement a high grayscale.

However, as shown in FIG. 5, when a sub-pixel implements a low grayscale, the control voltage Vct has a low level. Thus, the first control transistor CTT1 is turned off. Accordingly, a current flows between the high-potential voltage terminal and the third node N3 through the resistor R. Therefore, a predetermined amount of voltage drop occurs between the high-potential voltage terminal and the third node N3. That is, the resistance value between the high-potential voltage terminal and the driving transistor DRT may increase. Accordingly, the voltage of the third node N3 may have a level obtained by reflecting the level of voltage drop caused by the resistor R to the high-potential voltage.

Accordingly, as shown in FIG. 6, a voltage drop of 2 V occurs due to the resistor R in a VI curve of the driving transistor DRT when a sub-pixel implements a low grayscale. Therefore, the voltage of the third node N3, which is the source electrode of the driving transistor DRT, is 11 V. Also, a voltage between the source electrode and the drain electrode (the second node N2 and the third node N3) of the driving transistor DRT is 10 V. Therefore, the voltage of the second node N2 is 1 V. Further, a voltage between the anode electrode and the cathode electrode of the light emitting diode LED is 1 V in a VI curve of the light emitting diode LED. Therefore, a low driving current flows in the light emitting diode LED, which makes it possible to implement a low grayscale.

In a conventional display device, even when a sub-pixel implements a low grayscale, the variable resistance circuit is not disposed. Therefore, the drain electrode of the driving transistor has a high-potential voltage. Accordingly, as shown in FIG. 6, a voltage between the source electrode and the drain electrode of the driving transistor is 11 V in the VI curve of the driving transistor DRT when a sub-pixel implements a low grayscale. Therefore, a voltage of the anode electrode of the light emitting diode is 2 V. In this case, a driving current cannot be maintained constant in the VI curve of the driving transistor and a kink effect in which the driving current rapidly increases occurs. Therefore, the light emitting diode outputs light with a relatively high brightness. Accordingly, in the conventional display device, the sub-pixel cannot normally implement a low grayscale.

However, in the display device of the present disclosure, the variable resistance circuit is disposed between the high-potential voltage terminal and the driving transistor. Thus, when a sub-pixel implements a low grayscale, a voltage of the drain electrode of the driving transistor is shifted to suppress a kink effect in the driving transistor.

Therefore, in the display device of the present disclosure, a low driving current can flow in the light emitting diode, and, thus, the sub-pixel can normally implement a low grayscale.

The exemplary embodiments of the present disclosure can also be described as follows:

According to an aspect of the present disclosure, the display device includes a display panel in which a plurality of sub-pixels is disposed. Also, the display device includes a data driver configured to supply a plurality of data voltages to the plurality of sub-pixels through a plurality of data lines. Further, the display device includes a gate driver configured to supply a plurality of gate signals to the plurality of sub-pixels through a plurality of gate lines. Each of the plurality of sub-pixels includes a light emitting diode, a driving transistor, and a variable resistance circuit disposed in series between a low-potential voltage terminal and a high-potential voltage terminal. When each of the plurality of sub-pixels implements a low grayscale, the variable resistance circuit increases a resistance between the high-potential voltage terminal and the driving transistor. Thus, a low grayscale can be normally implemented.

The variable resistance circuit may include a first control transistor, a second control transistor, and a resistor, the first control transistor and the resistor are connected in parallel between the high-potential voltage terminal and the driving transistor, and the second control transistor controls the first control transistor.

The first control transistor may be turned off when each of the plurality of sub-pixels implements a low grayscale and turned on when each of the plurality of sub-pixels implements a high grayscale.

A gate electrode of the first control transistor may be connected to the second control transistor, a drain electrode of the first control transistor is connected to the high-potential voltage terminal, and a source electrode of the first control transistor is connected to the driving transistor.

The resistor may be disposed between a source electrode and a drain electrode of the first control transistor.

A gate electrode of the second control transistor may be connected to one of the plurality gate lines for transmitting a scan signal, a drain electrode of the second control transistor may be connected to a control line for transmitting a control voltage, and a source electrode of the second control transistor may be connected to the first control transistor.

The control voltage has a turn-off level when the data voltage may be lower than a threshold voltage and has a turn- on level when the data voltage is higher than the threshold voltage.

The level of the control voltage may be changed before a writing period in which the data voltage is written to the plurality of sub-pixels.

A voltage level of a gate electrode of the first control transistor may be changed in the writing period.

The variable resistance circuit may further include a control capacitor connected to a gate electrode of the first control transistor.

The control capacitor may be connected to a source electrode of the first control transistor.

The control capacitor may be connected to a reference voltage line for applying a reference voltage which is a constant voltage.

Each of the plurality of sub-pixels further may include a switching transistor that applies the data voltage to the driving transistor, a storage transistor that stores therein a gate-source voltage of the driving transistor and a sensing transistor that applies a reference voltage to the light emitting diode and thus senses the light emitting diode.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel in which a plurality of sub-pixels is disposed;

a data driver configured to supply a plurality of data voltages to the plurality of sub-pixels through a plurality of data lines; and a gate driver configured to supply a plurality of gate signals to the plurality of sub-pixels through a plurality of gate lines, wherein each of the plurality of sub-pixels includes a light emitting diode, a driving transistor, and a variable resistance circuit disposed in series between a low-potential voltage terminal and a high-potential voltage terminal, and when each of the plurality of sub-pixels implements a low grayscale, the variable resistance circuit increases a resistance between the high-potential voltage terminal and the driving transistor.

2. The display device according to claim 1, wherein the variable resistance circuit includes a first control transistor, a second control transistor, and a resistor, the first control transistor and the resistor are connected in parallel between the high-potential voltage terminal and the driving transistor, and the second control transistor controls the first control transistor.

3. The display device according to claim 2, wherein the first control transistor is turned off when each of the plurality of sub-pixels implements a low grayscale and turned on when each of the plurality of sub-pixels implements a high grayscale.

4. The display device according to claim 2, wherein a gate electrode of the first control transistor is connected to the second control transistor, a drain electrode of the first control transistor is connected to the high-potential voltage terminal, and a source electrode of the first control transistor is connected to the driving transistor.

5. The display device according to claim 2, wherein the resistor is disposed between a source electrode and a drain electrode of the first control transistor.

6. The display device according to claim 2, wherein a gate electrode of the second control transistor is connected to one of the plurality gate lines for transmitting a scan signal, a drain electrode of the second control transistor is connected to a control line for transmitting a control voltage, and a source electrode of the second control transistor is connected to the first control transistor.

7. The display device according to claim 6, wherein the control voltage has a turn-off level when the data voltage is lower than a threshold voltage and has a turn-on level when the data voltage is higher than the threshold voltage.

8. The display device according to claim 7, wherein the level of the control voltage is changed before a writing period in which the data voltage is written to the plurality of sub-pixels.

9. The display device according to claim 8, wherein a voltage level of a gate electrode of the first control transistor is changed in the writing period.

10. The display device according to claim 2, wherein the variable resistance circuit further includes a control capacitor connected to a gate electrode of the first control transistor.

11. The display device according to claim 10, wherein the control capacitor is connected to a source electrode of the first control transistor.

12. The display device according to claim 10, wherein the control capacitor is connected to a reference voltage line for applying a reference voltage which is a constant voltage.

13. The display device according to claim 1, wherein each of the plurality of sub-pixels further includes:

a switching transistor that applies the data voltage to the driving transistor;

a storage transistor that stores therein a gate-source voltage of the driving transistor; and a sensing transistor that applies a reference voltage to the light emitting diode and thus senses the light emitting diode.

* * * * *